US011263864B2

(12) United States Patent
Hodgson et al.

(10) Patent No.: US 11,263,864 B2
(45) Date of Patent: Mar. 1, 2022

(54) GAMING DEVICES CONFIGURABLE IN A SAWTOOTH-SHAPED GEOMETRIC ARRANGEMENT

(71) Applicant: Incredible Technologies, Inc., Vernon Hills, IL (US)

(72) Inventors: Lawrence Hodgson, Las Vegas, NV (US); Daniel Schrementi, Chicago, IL (US); Omar Torres, Barrington, IL (US); Bryan McVey, Chicago, IL (US); Steve Jaskowiak, Sleepy Hollow, IL (US); Garrett Marshall, Caledonia, IL (US)

(73) Assignee: Incredible Technologies, Inc., Vernon Hills, IL (US)

( * ) Notice: Subject to any disclaimer, the term of this patent is extended or adjusted under 35 U.S.C. 154(b) by 257 days.

(21) Appl. No.: 16/243,339

(22) Filed: Jan. 9, 2019

(65) Prior Publication Data

US 2020/0118383 A1 Apr. 16, 2020

Related U.S. Application Data

(63) Continuation-in-part of application No. 29/666,853, filed on Oct. 16, 2018, now Pat. No. Des. 888,833.

(51) Int. Cl.
*G07F 17/32* (2006.01)

(52) U.S. Cl.
CPC ..... *G07F 17/3216* (2013.01); *G07F 17/3209* (2013.01); *G07F 17/3211* (2013.01); *G07F 17/323* (2013.01)

(58) Field of Classification Search
CPC ..... G07F 17/3209; G07F 17/3211; G07F 17/3216; G07F 17/323
USPC ..... 463/30
See application file for complete search history.

(56) References Cited

U.S. PATENT DOCUMENTS 5,067,543 A * 11/1991 Bove ..... E04B 2/7429 160/135
2005/0003891 A1* 1/2005 Serizawa ..... G06T 17/20 463/31
2009/0253500 A1* 10/2009 Nagano ..... G07F 17/3211 463/30
2013/0165235 A1* 6/2013 Chun ..... G07F 17/3209 463/42
2013/0316794 A1* 11/2013 Pececnik ..... G07F 17/32 463/25
2016/0335835 A1* 11/2016 Castro ..... G07F 17/3216

* cited by examiner

*Primary Examiner* — Kang Hu
*Assistant Examiner* — Wei Lee
(74) *Attorney, Agent, or Firm* — Levenfeld Pearlstein, LLC

(57) ABSTRACT

A gaming system having gaming machines or devices configurable in a 'z'-shaped geometric arrangement are provided. The gaming system can include a plurality of gaming machines having a respective main display screen and a plurality of secondary display screens. Each of the plurality of gaming machines can be spaced apart from one another in a first direction with the respective main display of each of the plurality of gaming machines being parallel to each other. Each of the plurality of secondary screens can be coupled between the respective main display screen of respective ones of the plurality of gaming machines to fill a gap therebetween and are positioned at an angle with respect to the respective main display screen of the respective ones of the plurality of gaming machines.

20 Claims, 5 Drawing Sheets

GAMING DEVICES CONFIGURABLE IN A SAWTOOTH-SHAPED GEOMETRIC ARRANGEMENT

CROSS REFERENCE TO RELATED APPLICATIONS

The present application is a continuation-in-part of U.S. Design patent application Ser. No. 29/666,853 filed Oct. 16, 2018 entitled "CONFIGURATION OF ELECTRONIC DISPLAY SCREENS FOR GAMING MACHINES," the entirety of which is hereby incorporated herein by reference as if set forth fully herein.

FIELD

The present invention relates to electronic gaming devices. More particularly, the present invention relates to gaming devices configurable in a sawtooth or 'Z'-shaped geometric arrangement.

BACKGROUND

Traditional gaming devices are commonly designed and deployed for use in parallel (e.g., side-by-side or back to back) or standalone configurations. Such known configurations poorly utilize space in an area where the gaming devices are located and/or provide for uncomfortable or cramped operating conditions for users and others walking through the area. Conventional gaming devices and configurations also provide limited display presentation capabilities of visual content presented on the devices electronic display screen—often times requiring a person to be directly in front of the gaming machine(s) in order to fully see such visual content. Traditional gaming machines and machine configurations also tend to result in the formation of generic grid-type arrangements across a floor of a gaming venue with such formations being characterized by long linear rows or aisles. Such standard arrangements can create an institutional and uninviting atmosphere to gaming patrons and can further be difficult to traverse and/or locate games of potential interest.

Since gaming machines are usually made available for play on a revenue generating basis for a gaming establishment or operator it is generally desirable to develop and provide features or capabilities which will encourage and promote play. Accordingly, designers of gaming machines continually strive to develop variations and improvements of gaming technology which can provide a more comfortable and engaging atmosphere for players so that players will be motivated to play the games, continue playing the games and/or want to return to play certain games again in the future. In view of the above, there is a continuing, ongoing need for improved systems and methods for providing new and innovative configurations of gaming machines to sustain player interest and create an innovative gaming atmosphere.

DETAILED DESCRIPTION

Figure 1:
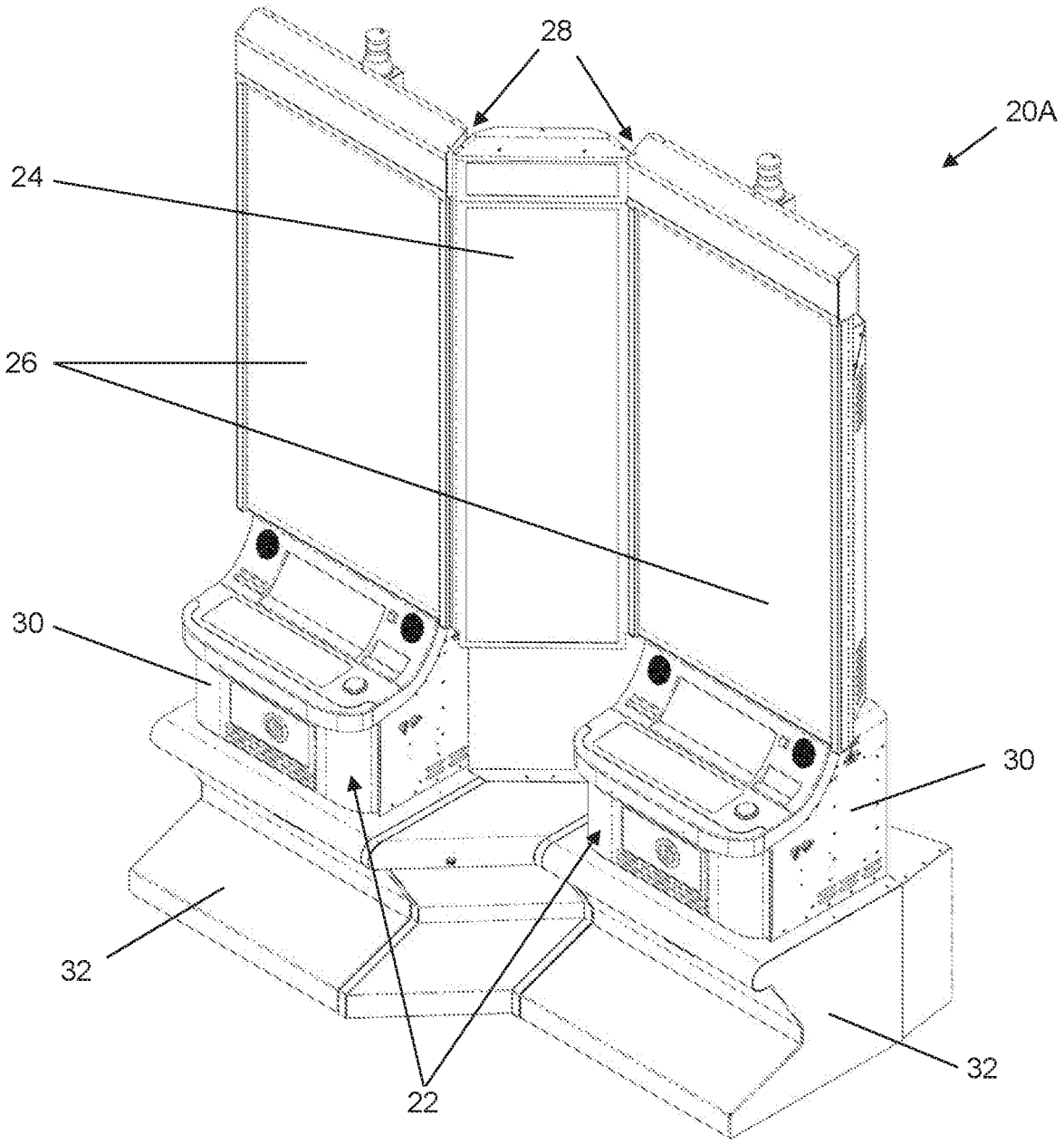
FIG. 1 is a perspective view of a gaming system in accordance with disclosed embodiments.

While this invention is susceptible of an embodiment in many different forms, there are shown in the drawings and will be described herein in detail specific embodiments thereof with the understanding that the present disclosure is to be considered as an exemplification of the principles of the invention. It is not intended to limit the invention to the specific illustrated embodiments.

Figure 1A:
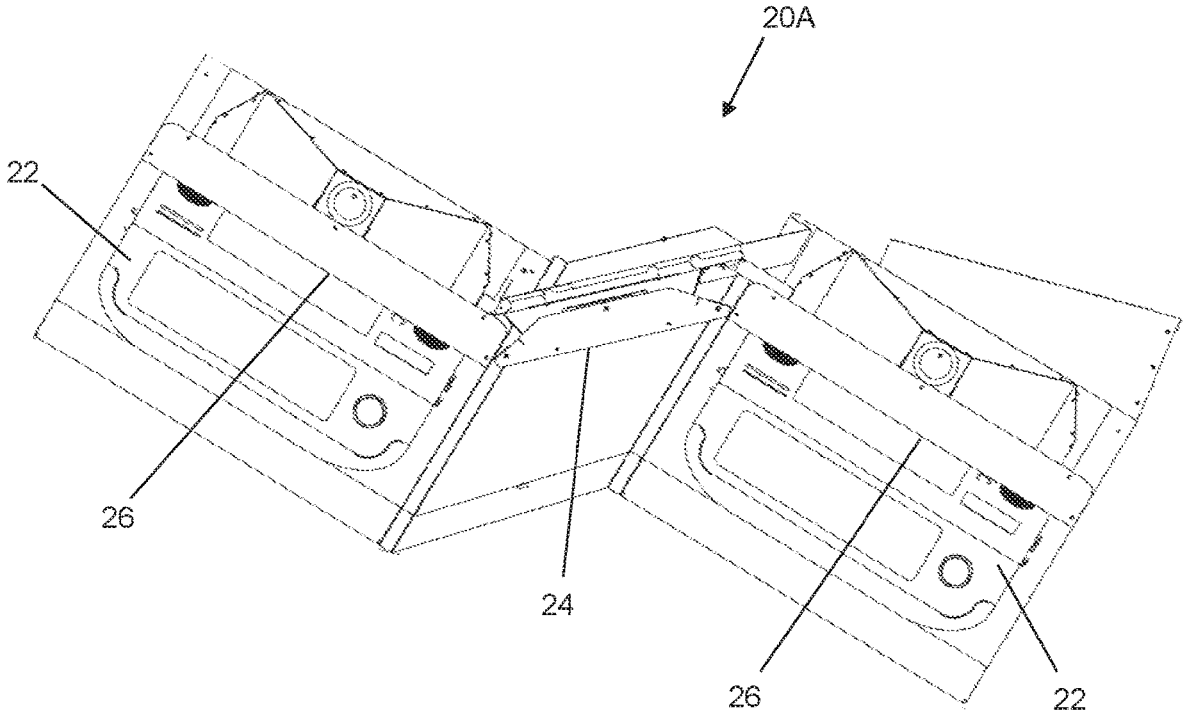
FIG. 1A is a top view of the gaming system of FIG. 1 in accordance with disclosed embodiments

FIGS. 1 and 1A illustrate an exemplary gaming system 20A in accordance with disclosed embodiments. As shown FIGS. 1 and 1A, system 20A can include a plurality of gaming machines or devices 22 spaced apart from one another in a first direction to form a 'z'-shaped, zig-zag or sawtooth configuration with a secondary display screen 24 provided between the gaming machines or devices 22 and joining such devices together. As shown schematically in FIGS. 1 and 1A, the plurality of gaming machines or devices 22 can include a main display screen 26, a base or control console 30 and a pedestal 32 that supports each of the plurality of gaming machines or devices 22. The main display screens 26 can include at least one edge 28 that can be physically coupled to the secondary display screen 24. The main display screens 26 and edge display screen can be coupled together along a portion of their respective sides. As shown schematically in FIGS. 1 and 1A, the side edges of the main display screens 26 and secondary display screen 24 (and more specifically, the frames or housings around the respective display screens) can be beveled to provide connection surfaces therebetween.

According to embodiments presented herein, the main display screens 26 can be positionable parallel to one another as shown in FIGS. 1 and 1A and the secondary display screen 24 can be positioned at an angle relative the main display screens 26—such arrangement providing a 'z'-shaped, zig zag or sawtooth configuration. The secondary display screen 24 can be oriented at an angle on the order of approximately 45 degree relative to the main display screens 26, although other angles are contemplated without limitation. For example, angles corresponding to various offset distances and directions of the plurality of gaming machines or devices 22 are contemplated.

It will be understood by a person of ordinary skill in the art that the orientation of the main display screens 26 relative the secondary display screen 24 and/or control console 30 can be varied in any number of respects. For example, such configurations and orientations can include, but are not limited to, one or both of the main display screens 26 and/or the secondary display screen 24 being provided in either a portrait or landscape orientation. Additionally, the secondary display screen 24 according to embodiments presented herein can be narrower than the main display screens 26 by having a width that is less than the width of the main display screens 26. It will be further understood that the length (or height) of the main display screens 26 can be substantially the same as secondary display screen 24 or be alternatively sized (either larger/smaller) as desired. It will be further understood, that although FIG. 1 shows secondary display screen 24 as being a single screen, secondary display screen 24 can be comprised of a multiple screens without departing from the scope of embodiments described herein—said multiple secondary display screens can be positionable in vertical and/or horizontal relation to one another.

According to embodiments presented herein, control console 30 can include a control array to enable a plater to initiate and control game content displayed on the main display screen 26. For example, the control console 30 can receive user input to initiate display of the game content on the main display screen 26 of an associated one or more gaming machines or devices 22, and additional visual content can be displayed on the secondary display screen 24 alongside the main display 26. According to embodiments presented herein, the secondary display screen 24 can be electronically isolated from the gaming machines and main display screens 26 with visual content on the secondary display screen 24 being controlled separately from the gaming machines such as to visually present information or content from the gaming venue or advertising/promotional material. Alternatively, secondary display 24 can be electronically integrated or coupled to the gaming devices and configured to display visual content associated with games being played on the devices 22.

Figure 2:
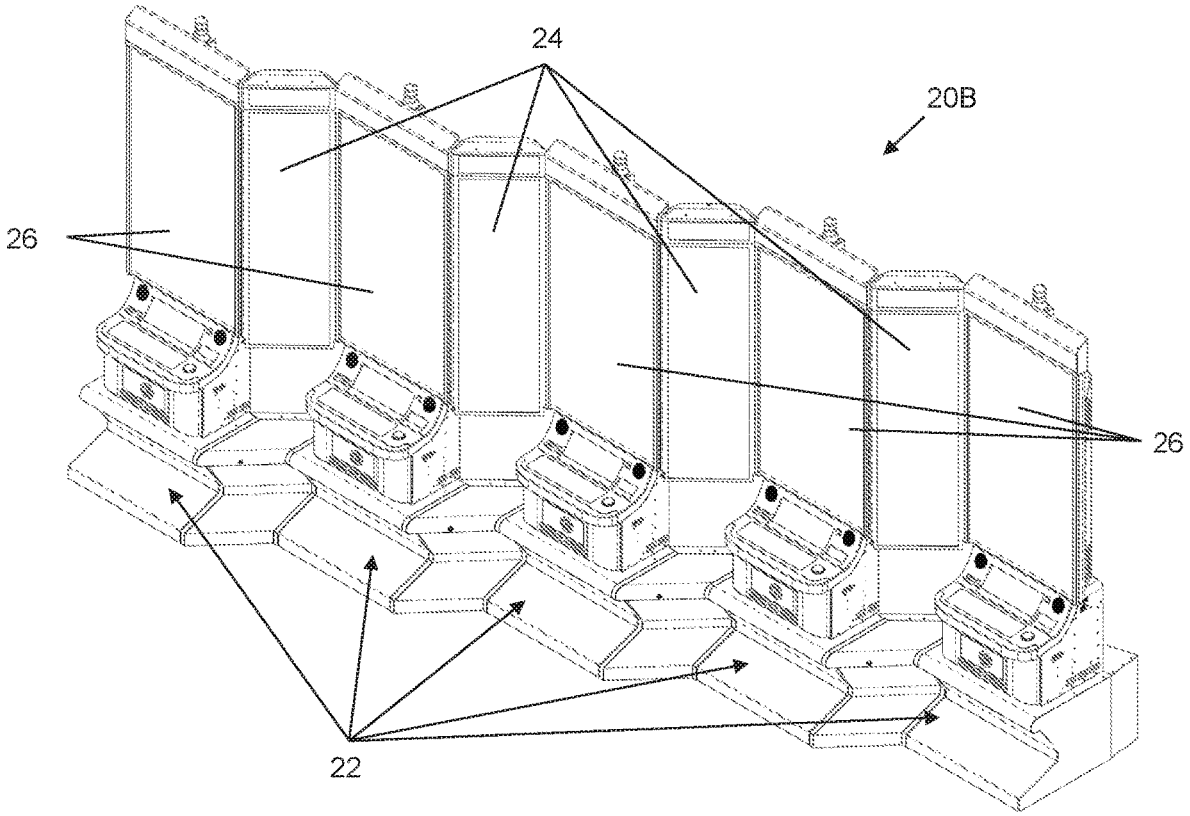
FIG. 2 is a perspective view of a gaming system in accordance with disclosed embodiments.
Figure 3:
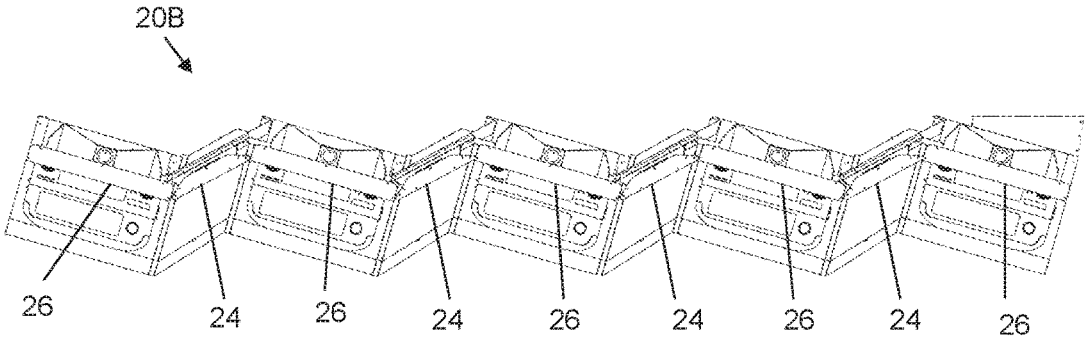
FIG. 3 is a top view of the gaming system of FIG. 2 in accordance with disclosed embodiments.

Additional configurations of gaming system 20A having additional gaming machines or device 22 are contemplated. For example, FIG. 2 is a perspective view of a gaming system 20B including a larger number of gaming machines or devices 22 and a plurality of secondary display screens 24 arranged in an extended 'z'-shaped or sawtooth configuration when compared to the gaming system 20A of FIG. 1. FIG. 3 is a top view of the gaming system 20B of FIG. 2.

Figure 4:
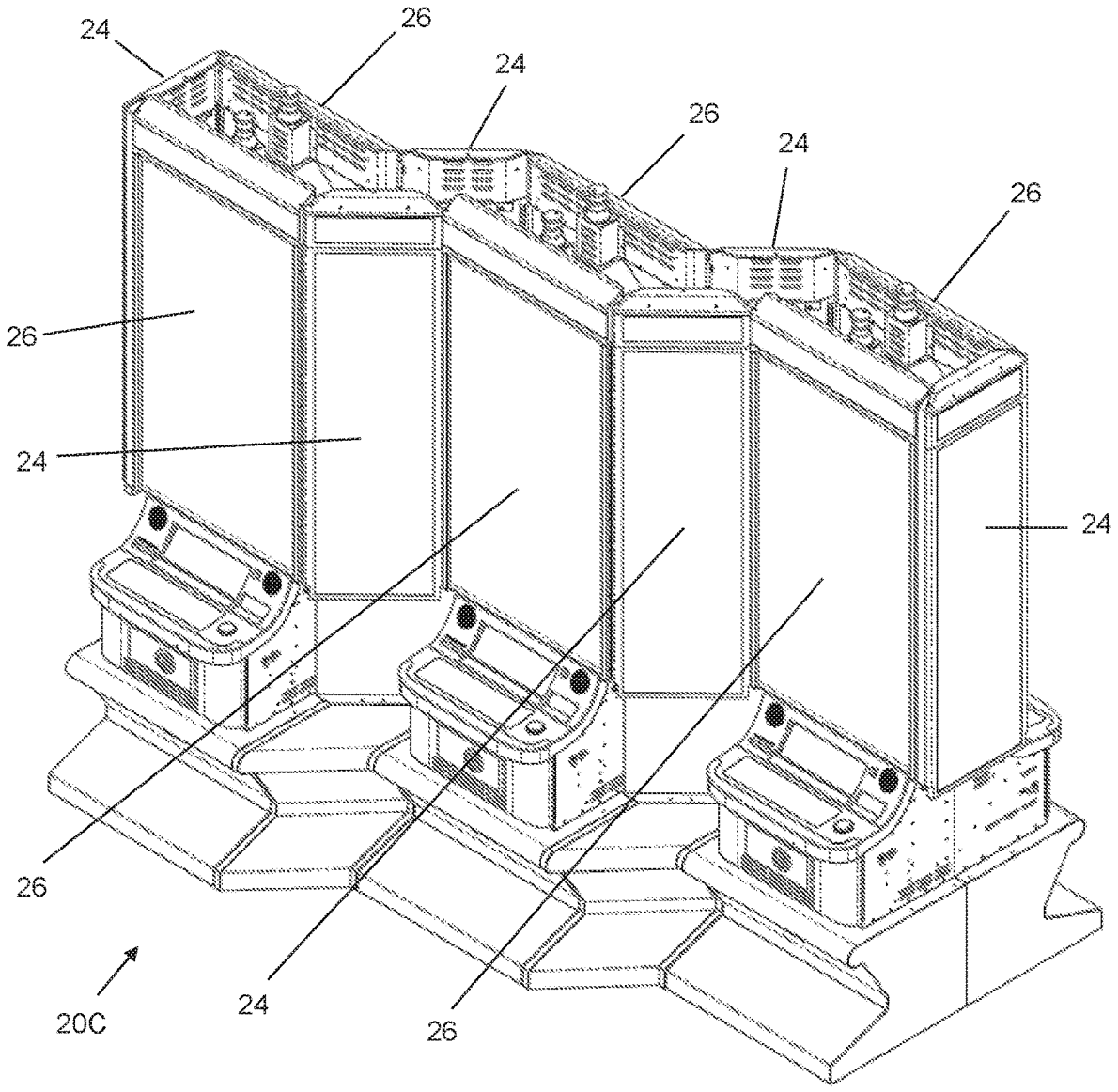
FIG. 4 is a perspective view of a gaming system in accordance with disclosed embodiments.
Figure 5:
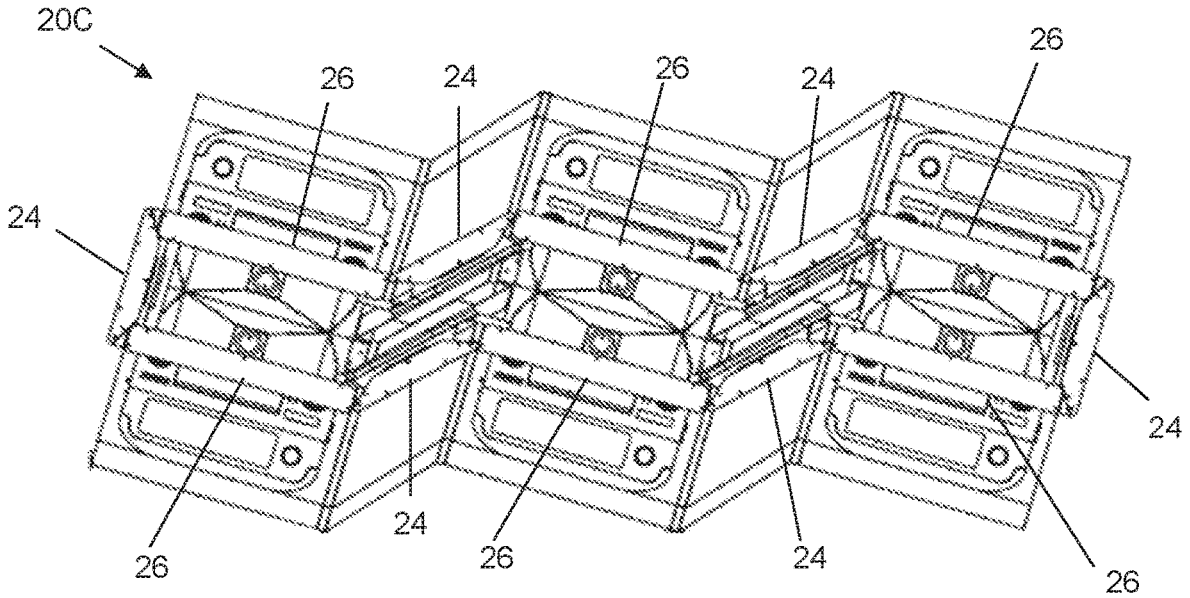
FIG. 5 is a top view of the gaming system of FIG. 4 in accordance with disclosed embodiments.
Figure 6:
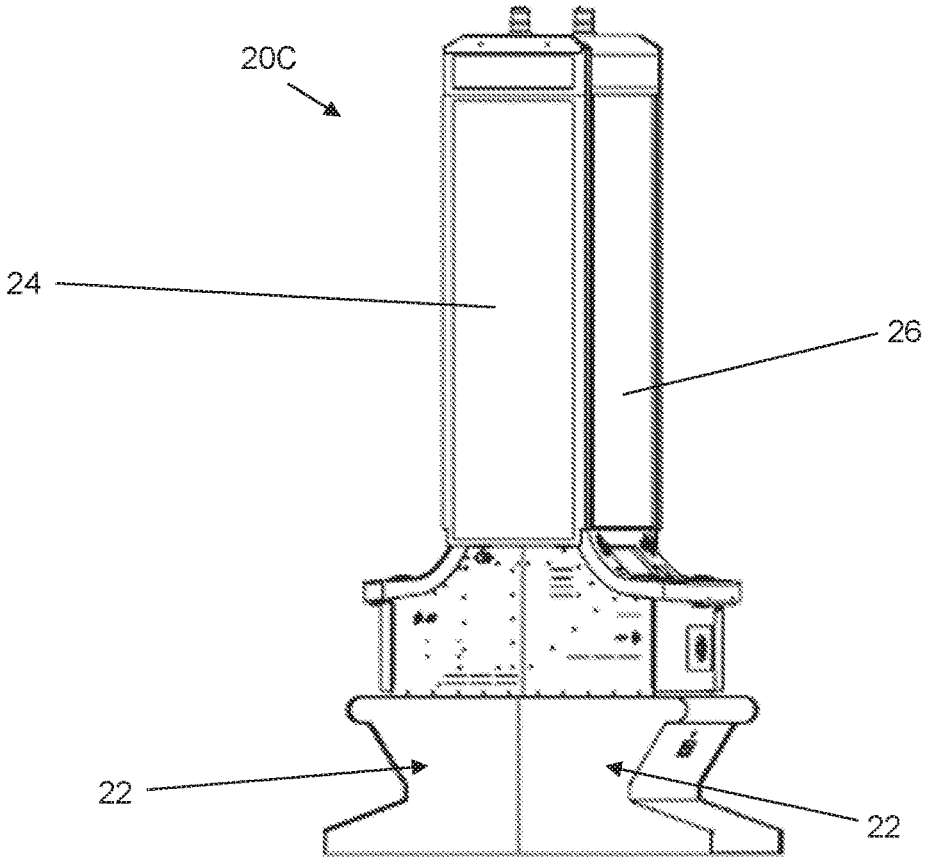
FIG. 6 is a side view of the gaming system of FIG. 4 in accordance with disclosed embodiments.

FIG. 4 is a perspective view of a gaming system 20C in accordance with disclosed embodiments and FIG. 5 is a top view of the gaming system 20C of FIG. 4 in accordance with disclosed embodiments. The gaming system 20C can include a larger number of gaming machines or devices 22 and can employ a plurality of secondary display screens 24 when compared to the gaming system 20A of FIG. 1. As shown in FIG. 4 and FIG. 5, the gaming machines or devices 22 of the gaming system 20C can be arranged in two parallel 'z'-shaped or sawtooth configurations connected at the ends by two of the plurality of secondary display screens 24. FIG. 6 is a side view of the gaming system 20C showing one of the plurality of secondary display screens 24 as an end screen connecting the two parallel 'z'-shaped or sawtooth configurations of the plurality of gaming machines or devices 22. In some embodiments, the ones of the plurality of secondary display screens 24 used as end screens to connect the ends of the two parallel 'z'-shaped or sawtooth configurations of the plurality of gaming machines or devices 22 can have different dimensions than the plurality of secondary display screens filling the gaps between the main display screens 26 of the plurality of gaming machines or devices 22.

Although a few embodiments have been described in detail above, other modifications are possible. For example, the logic flows described above do not require the particular order described or sequential order to achieve desirable results. Other steps may be provided, steps may be eliminated from the described flows, and other components may be added to or removed from the described systems. Other embodiments may be within the scope of the invention.

From the foregoing, it will be observed that numerous variations and modifications may be effected without departing from the spirit and scope of the invention. It is to be understood that no limitation with respect to the specific system or method described herein is intended or should be inferred. It is, of course, intended to cover all such modifications as fall within the spirit and scope of the invention.

What is claimed is:

1. A gaming system comprising:

a plurality of gaming machines having a respective main display screen having opposing first and second side edges; and a plurality of secondary display screens having opposing first and second side edges, wherein each of the plurality of gaming machines are spaced apart from one another in a first direction with the respective main display screens of each of the plurality of gaming machines being parallel to each other, the main display screens being oriented at an acute angle relative the first direction whereby the first side edges of the main display screens are in alignment in the first direction and the second side edges of the main display screens are oriented behind the first side edges in a second direction perpendicular to the first direction, and wherein each of the plurality of secondary screens are contiguously coupled between the respective main display screen of respective ones of the plurality of gaming machines to fill a gap therebetween and are positioned at a fixed angle with respect to the respective main display screen of the respective ones of the plurality of gaming machines, the first side edges of the plurality of secondary display screens being flush against a second side edge of the main display screen of an adjacent one of the plurality of gaming machines and the second side edges of the plurality of secondary display screens being flush against a first side edge of the main display screen of a second adjacent one of the plurality of gaming machines, the second side edges of the plurality of secondary display screens are in the alignment in the first direction.

2. The gaming system of claim 1 wherein a respective width of each of the plurality of secondary display screens is less than a respective width of the respective main display screen of each of the plurality of gaming machines.

3. The gaming system of claim 1 wherein the respective main display of each of the plurality of gaming machines and each of the plurality of secondary display screens are positioned in a portrait orientation.

4. The gaming system of claim 1 wherein each of the plurality of secondary display screens are positioned at an approximately 45 degree angle with respect to the respective main display screen of the respective ones of the plurality of gaming machines.

5. The gaming system of claim 1 further comprising a plurality of pedestals that each respectively support respective ones of the plurality of gaming machines.

6. The gaming system of claim 1 wherein content displayed on each of the plurality of secondary display screens is integrated with content displayed on one or both of the respective main display screens of the respective ones of the plurality of gaming machines.

7. The gaming system of claim 1 wherein content displayed on each of the plurality of secondary display screens is independent of content displayed on both of the respective ones of the plurality of gaming machines.

8. Gaming devices configurable in a 'Z'-shaped geometric arrangement comprising:

a first gaming device including a main display;

a second gaming device offset from the first gaming device in a first direction and including a main display screen parallel to the main display screen of the first gaming device;

the main displays of the first and second gaming devices having opposing first and second side edges and being oriented at an acute angle relative the first direction whereby the first side edges of the main displays are in alignment in the first direction and the second side edges are oriented behind the first side edges in a second direction perpendicular to the first direction, and a secondary display screen contiguously coupled to the main displays of the first and second gaming devices, the secondary display screen having opposing first and second side edges, the first side edge of the secondary display screen being flush against the second side edge of the main display of the first gaming device and the second side edge of the secondary display screen being flush against the first side edge of the main display of the second gaming device;

wherein the secondary display screen fills a gap between the first gamming device and the second gamming device and is positioned at fixed angle with respect to the main display screens of the first and second gaming devices to form the 'Z'-shaped geometric arrangement.

9. The gaming devices of claim 8 wherein a width of the secondary display screen is less than a respective width of the main display screens of the first and second gaming devices.

10. The gaming devices of claim 8 wherein the main display screens of the first and second gaming devices and the secondary display screen are positioned in a portrait orientation.

11. The gaming devices of claim 8 wherein the secondary display screen is positioned at an approximately 45 degree angle with respect to the main display screens of the first and second gaming devices.

12. The gaming devices of claim 8 further comprising:

a first pedestal that supports the first gaming device; and a second pedestal that supports the second gaming device.

13. The gaming devices of claim 8 wherein content displayed on the secondary display screen is integrated with content displayed on one or both of the main display screens of the first and second gaming devices.

14. The gaming devices of claim 8 wherein content displayed on the secondary display screen is independent of content displayed on both of the main display screens of the first and second gaming devices.

15. A method for presenting game content on a plurality of gaming machines configured in a 'Z'-shaped geometric arrangement comprising:

providing a first gaming device including a main display screen;

providing a second gaming device offset from the first gaming device in a first direction and including a main display screen parallel to the main display screen of the first gaming device;

the main display screens of the first and second gaming devices having opposing first and second side edges and being oriented at an acute angle relative the first direction whereby the first side edges of the main displays are in alignment in the first direction and the second side edges are oriented behind the first side edges in a second direction perpendicular to the first direction, providing a secondary display screen contiguously coupled to the main display screens of the first and second gaming devices, wherein the secondary display screen fills a gap between the first gamming device and the second gamming device and is positioned at fixed angle with respect to the main display screens of the first and second gaming devices to form the 'Z'-shaped geometric arrangement, the secondary display screen having opposing first and second side edges, the first side edge of the secondary display screen being flush against the second side edge of the main display screen of the first gaming device and the second side edge of the secondary display screen being flush against the first side edge of the main display screen of the second gaming device and in the alignment in the first direction;

receiving user input on the first gaming device or the second gaming device to initiate display of the game content on the main display screen of the first gaming device or the second gaming device; and displaying additional content on the secondary display screen alongside the gaming content.

16. The method of claim 15 wherein a width of the secondary display screen is less than a respective width of the main display screens of the first and second gaming devices.

17. The method of claim 15 wherein the secondary display screen is positioned at an approximately 45 degree angle with respect to the main display screens of the first and second gaming machines.

18. The method of claim 15 further comprising:

providing a first pedestal that supports the first gaming machine; and providing a second pedestal that supports the second gaming machine.

19. The method of claim 15 wherein the additional content displayed on the secondary display screen is integrated with the game content displayed on the main display screen of the first gaming device or the second gaming device.

20. The method of claim 15 wherein the additional content displayed on the secondary display screen is independent of the game content displayed on the main display screen of the first gaming device or the second gaming device.

* * * * *